US011084620B2

(12) United States Patent
Bourne

(10) Patent No.: US 11,084,620 B2
(45) Date of Patent: Aug. 10, 2021

(54) PACKAGING AND BLANK THEREFOR

(71) Applicant: MAYR-MELNHOF KARTON AG, Vienna (AT)

(72) Inventor: Timothy John Bourne, Northumberland (GB)

(73) Assignee: MAYR-MELNHOF KARTON AG, Vienna (AT)

( * ) Notice: Subject to any disclaimer, the term of this patent is extended or adjusted under 35 U.S.C. 154(b) by 0 days.

(21) Appl. No.: 16/608,939

(22) PCT Filed: Apr. 28, 2017

(86) PCT No.: PCT/EP2017/060225

§ 371 (c)(1),
(2) Date: Oct. 28, 2019

(87) PCT Pub. No.: WO2018/197002

PCT Pub. Date: Nov. 1, 2018

(65) Prior Publication Data

US 2020/0189790 A1 Jun. 18, 2020

(51) Int. Cl.
*B65D 5/54* (2006.01)
*B65D 5/02* (2006.01)

(52) U.S. Cl.
CPC ..... *B65D 5/5425* (2013.01); *B65D 5/029* (2013.01)

(58) Field of Classification Search
CPC ..... B65D 5/029; B65D 5/10; B65D 5/5425; B65D 5/443; B65D 5/4279; B31B 50/28; B31B 50/282

(Continued)

(56) References Cited

U.S. PATENT DOCUMENTS 5,147,271 A 9/1992 Bacques et al.
7,350,670 B2 * 4/2008 Steeves ..... B65D 77/065 222/105

(Continued)

FOREIGN PATENT DOCUMENTS

DE 20 2004 011 165 U1 12/2005
EP 0 468 860 A1 1/1992

(Continued)

OTHER PUBLICATIONS

International Search Report dated Jan. 16, 2018 in corresponding International Patent Application No. PCT/EP2017/060225.

(Continued)

*Primary Examiner* — Christopher R Demeree
(74) *Attorney, Agent, or Firm* — Medler Ferro Woodhouse & Mills PLLC

(57) ABSTRACT

A packaging is disclosed that is made from cardboard, paper or similar, and includes a base wall and a cover wall, at least one front wall and one rear wall connecting the base wall and the cover wall in order to form lateral sides of the packaging. The packaging is designed as a prismatic body along a longitudinal axis extending parallel to the base wall and cover wall, and at least one lateral closure coupled to the base wall and/or the cover wall for laterally closing the packaging. At least one lateral closure is designed in such a way that, in a closed position, it rests at least in regions at least on one of the front walls or real walls coupled to the base wall and cover wall and protrudes at least regionally over these. The disclosure also relates to a blank for producing such a packaging.

15 Claims, 5 Drawing Sheets

(58) Field of Classification Search
USPC ..... 229/108, 109, 190, 141, 918; 206/509, 206/521, 586
See application file for complete search history.

(56) References Cited

U.S. PATENT DOCUMENTS 7,717,838 B2 * 5/2010 Strong ..... B65D 5/722 493/175
7,857,743 B2 * 12/2010 Barner ..... B65D 5/48024 493/175
7,935,041 B2 * 5/2011 Graham ..... B65D 5/566 493/98
8,011,564 B2 * 9/2011 Garner ..... B65D 71/36 229/110
8,800,854 B2 * 8/2014 Chapman ..... B65D 5/48042 229/199
9,022,913 B2 * 5/2015 Graham ..... B65D 5/0227 493/51
9,114,921 B2 * 8/2015 Smith ..... B65D 5/0227
9,409,367 B2 * 8/2016 Graham ..... B31B 50/00
9,701,087 B2 * 7/2017 Graham ..... B31B 50/00
9,701,088 B2 * 7/2017 Strong ..... B65D 5/029
9,919,830 B2 * 3/2018 Smith ..... B65D 5/443
2008/0203142 A1 8/2008 Grossmann et al.
2010/0219232 A1 9/2010 Smith
2011/0111938 A1 5/2011 Smith

FOREIGN PATENT DOCUMENTS

JP 2015030246 A 2/2015
WO 2015/010726 A1 1/2015
WO 2015/011186 A1 1/2015

OTHER PUBLICATIONS

Office Action issued for Japanese Application No. 2019-557476, issued by the Japan Patent Office dated May 11, 2021 (with English translation).

* cited by examiner

Fig.3
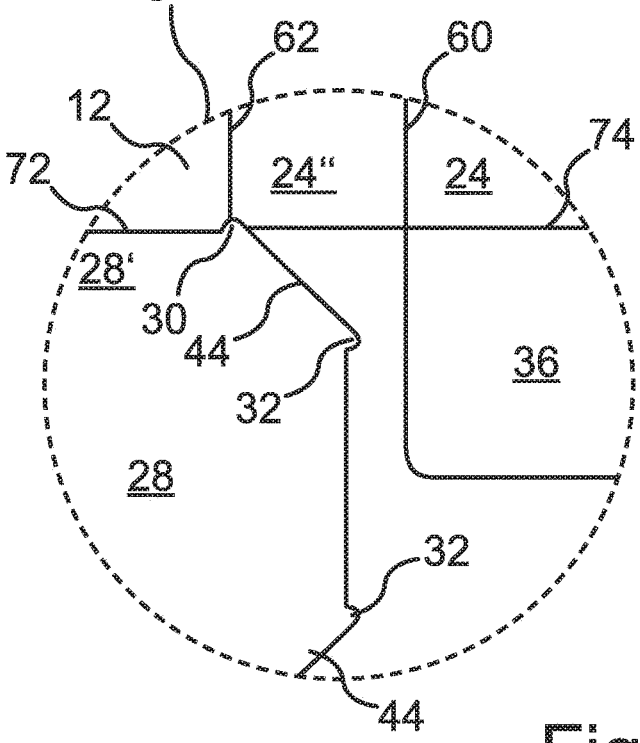
Fig.4
Fig.5
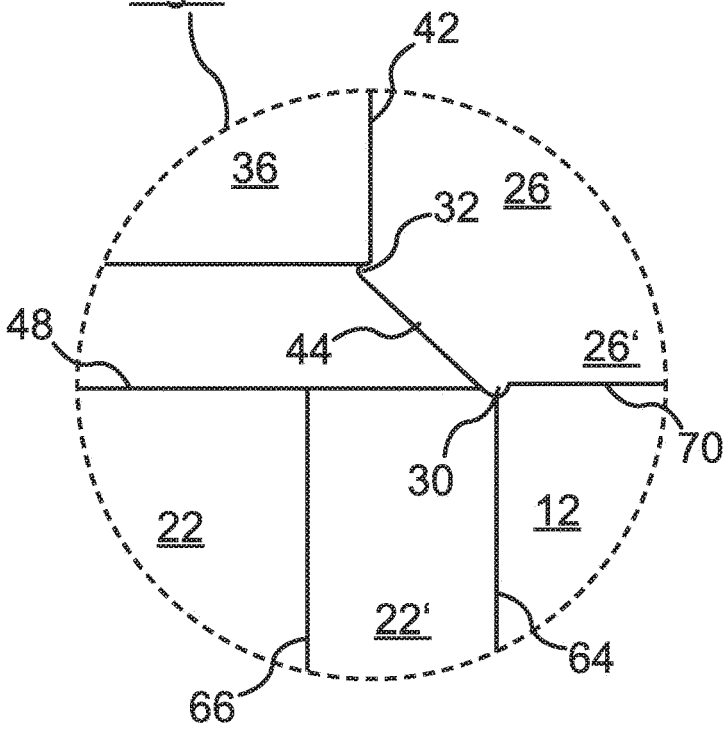
Fig.6

PACKAGING AND BLANK THEREFOR

The present invention relates to a packaging made of cardboard, paper or the like, comprising a base wall and a top wall, at least a respective front wall and rear wall, which connect the base wall and top wall and are intended for forming end sides of the packaging, wherein the packaging is designed in the form of a prismatic body along a longitudinal axis running parallel to the base wall and top wall, and also comprising at least a respective side flap, which is articulated on the base wall and/or the top wall and is intended for closing the packaging laterally. The invention also relates to a blank for producing such a packaging.

A large number of such packagings are known. In particular, such packagings are used for receiving, transporting and storing packaged or non-packaged free-flowing goods. The goods can be, for example, cereals, cornflakes or other pourable and free-flowing foods, or also washing powder and the like. However, it is also possible to store liquids, in appropriately liquid-tight intermediate packagings, in the aforementioned packagings. DE 20 2004 011 165 U1 discloses a powder-tight packaging for pulverulent goods. The known packaging here is designed in the form of a prismatic, octagonal body. The disadvantage with such prismatic-design packagings, however, is that a plurality of dust flaps have to be formed, in addition to the top flaps, for the purpose of sealing the top structure and/or base structure. In particular the corner regions of the top structure and/or base structure are exposed, in addition, to instability when subjected to compressive loading, for example when said packagings are stored or stacked one above the other. This can result in undesirable damage to the packaging. US 2011/111938 A1 and EP 0 468 860 A1 disclose comparable cardboard packagings and corresponding blanks. It is also the case that WO 2015/010726 A1 discloses similar packagings and blanks. However, the packagings disclosed here, as is also the case with the prior-art packagings described above, are "upright" prismatic bodies formed along a longitudinal axis, wherein the longitudinal axis runs parallel to a longitudinal extent of the front wall, rear wall and side walls. The longitudinal axis is therefore arranged perpendicularly to a base surface or top surface.

In the case of packagings of the type in question which are designed in the form of a "horizontally lying" prismatic body along a longitudinal axis running parallel to the base wall and top wall, the larger bearing surface area of the base wall and top wall and the "horizontally lying" stacking arrangement, for example in a sales rack, give rise to less compressive loading in the regions of the corresponding base structure and top structure. However, such packagings are protected only to an insufficient extent against loading of the side walls, in particular during storage or transportation of the packagings in the "upright" state, i.e. when the prismatic bodies are being stored with the longitudinal axis in an upright, vertically erected position.

It is therefore the object of the present invention to provide a packaging of the type in question and also a blank therefor which, alongside secure closure and reliable covering in the region of the side walls of the packaging, ensure increased loading stability of the packaging in said regions, in particular during "upright" storage or transportation of the packagings with the longitudinal axes in an upright, vertically erected position.

These objects are achieved by a packaging of the type in question according to the features of claim 1 and by a blank according to the features of claim 10. Advantageous configurations with expedient developments of the invention are specified in the respective dependent claims, wherein advantageous configurations of the packaging can be considered to be advantageous configurations of the blank, and vice versa.

A packaging according to the invention made of cardboard, paper or the like comprises a base wall and a top wall, at least a respective front wall and rear wall, which connect the base wall and top wall and are intended for forming end sides of the packaging, wherein the packaging is designed in the form of a prismatic body along a longitudinal axis running parallel to the base wall and top wall, and also comprises at least a respective side flap, which is articulated on the base wall and/or the top wall and is intended for closing the packaging laterally. At least one side flap here is designed such that, in a closed position, it rests, at least in part, at least on one of the front wall and rear wall, which connects the base wall and top wall, and projects beyond the same at least in part. The configuration of the side flap according to the invention ensures secure closure and reliable covering of those regions of the packaging which include the front wall and/or rear wall and/or the corresponding base wall and top wall. Furthermore, the fact that the side flap rests, at least in part, on the front wall and/or rear wall or walls of the packaging results in increased loading stability of the packaging in said regions. Such packagings can therefore readily be stacked one beside the other with the longitudinal axes of their prismatic bodies in an upright, vertically erected position, which is necessary, and advantageous, for example for dispatch on pallets. Furthermore, it is possible to use thicknesses of cardboard which are thinner, if appropriate, than in the case of previously known packagings. This reduction in the amount of material used means that the packaging according to the invention involves considerable cost-related advantages. Furthermore, the side flap is designed such that also in a closed position it projects, at least in part, beyond at least one front and/or rear wall, on which it rests. The fact that the side flap projects, at least in part, beyond the front wall and/or rear wall and also the corresponding dimensioning of the side flap ensure that a front end side and/or rear end side of the packaging is reliably covered over. Even possible compressive loading of said regions when the packaging according to the invention is stored in an upright position does not result in the side flap being displaced from its resting place on the front wall and/or rear wall. "Resting on the front wall and/or rear wall or walls" is also understood to mean that the side flap does not rest directly on a respective edge of the front wall and/or rear wall. It is thus also possible for the side flap to rest, at least in part, on a packaging element which is articulated on the respective front wall and/or rear wall, for example on a dust flap. The critical factor is that the side flap projects beyond the corresponding front wall and/or rear wall. In addition, it has surprisingly been found that the packagings according to the invention make it possible for the amount of material, in particular cardboard material, used to be reduced considerably during the production of said packagings. Depending on In further advantageous configurations of the packaging according to the invention, a width a of the side flap(s) in the region of their respective articulation on the base and/or top wall is greater than a width b of the corresponding base and/or top wall in said region. As a result, it is ensured in a simple structural manner that the corresponding side flap on the one hand rests on the corresponding front and/or rear wall or the corresponding front and rear walls, and projects beyond the same, at least in part. There is increased loading stability of the packaging, a secure closure of the packaging and the possibility of an automated process of erecting and filling the packaging. Furthermore, there is the possibility that the side flap has at least one overhang in the non-articulated region in such a way that, in the closed position of the packaging, it projects beyond at least one front or rear wall, at least in part. In this case, a resting nose may be respectively formed at the opposite ends of the overhang. Also in this way, a secure closure of the packaging is ensured, with at the same time increased dimensional stability in said regions of the packaging. There is also the possibility that, on at least one side flap, at least one dust flap is articulated in a region different from the overhang. In turn, a secure closure of the packaging is ensured in said regions of the packaging.

In further advantageous configurations of the packaging according to the invention, the side flap is designed such that, in the closed position, it completely or at least partially covers over the region, formed by the front and/or rear walls arranged on the end sides, of a cross-sectional surface of the packaging formed as a prismatic body, wherein the cross-sectional surface is formed perpendicularly to the longitudinal axis. There is also the possibility that two side flaps are respectively designed such that, in the closed position, it completely or at least partially covers over the region, formed by the front and/or rear walls arranged on the end sides, of a cross-sectional surface of the packaging formed as a prismatic body, wherein the cross-sectional surface is formed perpendicularly to the longitudinal axis. This ensures that, irrespective of the cross-sectional surface of the prismatic-design packaging, the surfaces formed by the front or rear walls are reliably covered over, and closed, by the side flaps.

In a further advantageous configuration of the packaging according to the invention, at least one tear-open flap is formed within the top wall. As a result, the packaging can be readily opened.

In further advantageous configurations of the packaging according to the invention, a cross-sectional surface is of polygonal design, in particular quadrilateral, pentagonal, hexagonal, heptagonal, octagonal, nonagonal, decagonal or dodecagonal design, in a direction perpendicular to the longitudinal axis of the packaging of the prismatic-body-design packaging. However, other shapes, for example round shapes or combinations of round and polygonal shapes, are also possible. In addition, it has surprisingly been found that the packagings according to the invention make it possible for the amount of material, in particular cardboard material, used to be reduced considerably during the production of said packagings. Depending on the number of corners of the cross-sectional surface, it is possible for the amount of material used to be reduced by between 9% and 14%, with the volume remaining constant in relation to a conventional packaging. This gives rise to the amount of material used being reduced, in the case of a generally pentagonal configuration of the cross-sectional surface, by approximately 9% and, in the case of octagonal packagings, by approximately 14%.

It is also possible for the cross-sectional surface of the packaging to be of triangular design. This embodiment can have independent inventive content. In order to form the triangular shape of the packaging, either the front wall or the rear wall is connected to the base wall and top wall, wherein the base wall and top wall, in turn, are connected directly to one another. At least one side flap, which is articulated on the base wall and/or top wall, is designed here such that, in a closed position, it rests, at least in part, at least on the front or rear wall, and projects beyond the same at least in part. The configuration of the side flap according to the invention ensures secure closure and reliable covering of this region of the packaging. Furthermore, the fact that the side flap rests, at least in part, on the front wall or rear wall results in increased loading stability of the packaging in said region. Such packagings can therefore readily be stacked one beside the other with the longitudinal axes of their prismatic bodies in an upright, vertically erected position, which is necessary, and advantageous, for example for dispatch on pallets.

A further aspect of the invention relates to a blank for producing a packaging made of cardboard, paper or the like, comprising base-wall, top-wall, front-wall and rear-wall elements, which are connected via folding lines and are intended for forming the packaging in the form of a prismatic body in the folded state of the blank. The blank here comprises at least a respective side flap, which is articulated on the base-wall element and/or the top-wall element. According to the invention, the at least one side flap is designed such that, in the folded state of the blank and in a closed position, it rests, at least in part, at least on a front-wall or rear-wall element connecting the base-wall and top-wall elements, and projects beyond the same at least in part. The one-piece form of the blank makes low-cost production of the blank and the packaging possible. A blank of such a design also ensures a secure closure and reliable covering of a packaging produced therefrom in the region of the packaging including the front-wall and/or rear-wall elements and the corresponding base-wall and top-wall elements. Furthermore, the fact that the side flap rests, at least in part, on the front wall and/or rear wall or walls of the folded packaging results in increased loading stability of the packaging in said regions. Such packagings can therefore readily be stacked one beside the other with the longitudinal axes of their prismatic bodies in an upright, vertically erected position, which is necessary, and advantageous, for example for dispatch on pallets. Furthermore, it is possible to use thicknesses of cardboard which are thinner, if appropriate, than in the case of previously known blanks and packagings. This reduction in the amount of material used means that the packaging according to the invention involves considerable cost-related advantages. Furthermore, the side flap is designed such that, also in a closed position of the folded packaging, it projects at least in part beyond at least one front and/or rear wall on which it rests. The fact that the side flap projects, at least in part, beyond the front wall and/or rear wall and the corresponding dimensioning of the side flap ensures that a front end side and/or rear end side of the packagings produced from the blank is reliably covered over. Even possible compressive loading of said regions when the packaging is stored in an upright position does not result in the side flap being displaced from its resting place on the front wall and/or rear wall.

In further advantageous configurations of the blank according to the invention, a width a of the side flap(s) in the region of its respective articulation on the base and/or top wall element is greater than a width b of the base-wall and/or top-wall element in said region. As a result, it is ensured in a simple structural manner that, in the folded state of the blank and in the closed position of the packaging produced therefrom, the corresponding side flap on the one hand rests on the corresponding front and/or rear wall or the corresponding front and rear walls, and projects beyond the same, at least in part. There is increased loading stability of the produced packaging, a secure closure of the packaging and the possibility of an automated process of erecting and filling the blank during the production of the packaging. Furthermore, there is the possibility that the side flap has at least one overhang in the non-articulated region in such a way that, in the folded state of the blank and in the closed position of the packaging in the closed position of the packaging, it projects beyond at least one front or rear wall, at least in part. In this case, a resting nose may be respectively formed at the opposite ends of the overhang. Also in this way, a secure closure of the packaging produced from the blank is ensured, with at the same time increased dimensional stability in said regions of the folded packaging. There is also the possibility that, on at least one side flap, at least one dust flap is articulated in a region different from the overhang. In turn, a secure closure of the packaging produced from the blank is ensured in said regions of the packaging.

In further advantageous configurations of the blank according to the invention, the side flaps are of a substantially polygonal design, in particular quadrilateral, pentagonal, hexagonal, heptagonal, octagonal, nonagonal, decagonal or dodecagonal design. However, other shapes, for example round shapes or combinations of round and polygonal shapes, are also possible. Triangular shapes are also conceivable. There is also the possibility that at least one tear-open flap is formed within the top wall element. As a result, the packaging produced from the blank according to the invention can be readily opened.

Further features of the invention can be gathered from the claims, from the exemplary embodiments and with reference to the drawings. The features and combinations of features mentioned above in the description, and also the features and combinations of features mentioned hereinbelow in relation to the exemplary embodiments, can be used not only in the combination specified in each case, but also in other combinations, without there being any departure from the framework of the invention. In the drawings:

FIG. 4 shows a schematic illustration of a detail of the blank shown in FIG. 3;

FIG. 6 shows a schematic illustration of a detail of the blank shown in FIG. 5.

Figure 1:
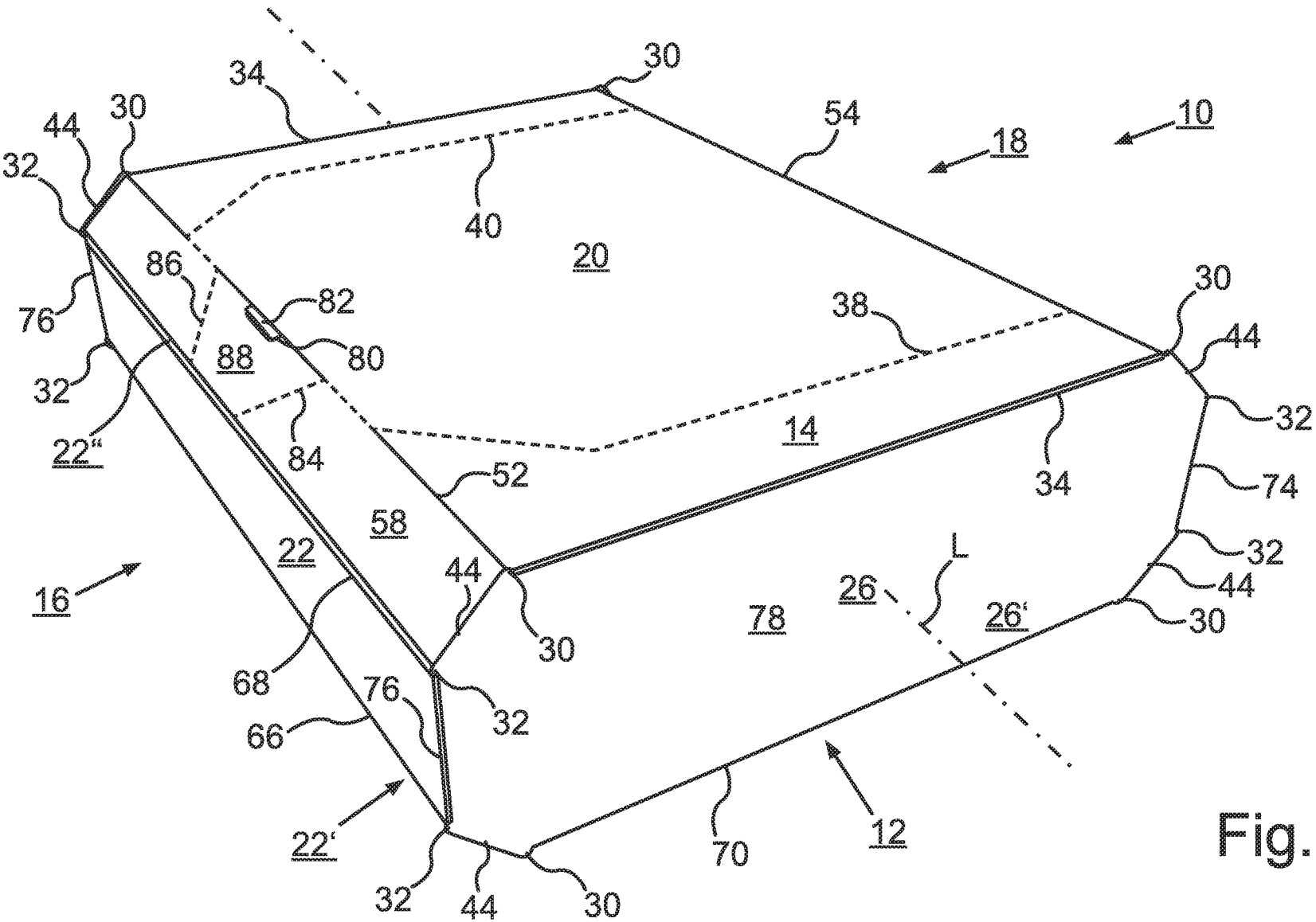
FIG. 1 shows a schematic illustration of a packaging according to the invention.

FIG. 1 shows a schematic illustration of a packaging 10, which serves in particular for storing and transporting packaged or non-packaged free-flowing goods. The goods here can be, for example, cereals, cornflakes or other pourable and free-flowing foods, or also washing powder and the like. However, it is also possible to store liquids, in appropriately liquid-tight intermediate packagings, in the packaging 10. The packaging 10 here has a base wall 12 and a top wall 14, which are connected via in each case three connecting front and rear walls 22, 22', 22", 24, 24', 24". The front and rear walls 22, 22', 22", 24, 24', 24" here form a front end side 16 and a rear end side 18 of the packaging 10. It can be seen that the packaging 10 is designed in the form of a prismatic body along a longitudinal axis running parallel to the base wall and top wall 12, 14. The cross-sectional surface 78 of the packaging 10 is generally of octagonal design in a direction perpendicular to said transverse axis. In addition, the packaging 10 has in each case one side flap 26, 28, which is articulated on the base wall and the top wall 12, 14 and is intended for closing the packaging 10 laterally (see also FIG. 2). The packaging 10 also comprises a total of four dust flaps 36 (see FIG. 3), which are each articulated on the front walls 22, 24 via folding lines 74, 76. The dust flaps 36 serve to close the packaging 10 laterally in the region of the front and rear end sides 16, 18. Furthermore, the top wall 14 has a tear-open flap 20, which is delimited in the top wall 14 via corresponding perforation lines 38, 40. In the region of an adhesive-bonding flap 58, which is articulated on the top wall 14 via a folding line 52, the tear-open flap 20 merges into a grip flap 88, which is defined via perforation lines 84, 86 formed in the adhesive-bonding flap 58. For easier opening of the tear-open flap 20, a cut line 80 is formed adjacent to the folding line 52, and within the grip flap 88, and serves to form a pull tab 82. It can be seen that the pull tab 82 projects slightly beyond the outlines of the prismatic body of the packaging 10 and is thus easy to grip.

It is also evident that the side flaps 26, 28 are designed such that, in the respective closed position, they rest, in part, on the front and rear walls 22', 22", 24', 24" connecting the bottom and top walls 12, 14 (also compare FIG. 3) and project beyond the same. For this, the side flaps 26, 28 have in their respective corner regions in each case an overhang 44, which in the closed position of the packaging 10 shown projects beyond said front and rear walls 22', 22", 24', 24", at least in part. It is evident that resting noses 30, 32 are respectively formed at the opposite ends of the respective overhangs 44. It is clear that the side flaps 26, 28 are designed such that, in the closed position of the packaging 10, they almost completely cover over the region of the cross-sectional surface 78 that is formed by the front and/or rear walls 22, 22', 22", 24, 24', 24" arranged at the end sides. It is also evident that the cross-sectional surface 78 is formed perpendicularly to the longitudinal axis L. According to further embodiments of the packaging 10, it is however also possible that two or more side flaps are respectively designed such that, in the closed position, they completely or at least partially cover over the region of the cross-sectional surface 78 that is formed by the front and rear walls 22, 22', 22", 24, 24', 24" arranged at the end sides.

Furthermore, it is evident that a dust flap 36 is respectively articulated on the front wall 22 and also the rear wall 24 via the folding lines 76, 74. Via the folding line 54, the rear-wall element 24' is articulated on the top wall 14 or the tear-open flap 20. The side flaps 26, 28 are respectively articulated on the base wall 12 via folding lines 70, 72 (see also FIG. 2). Arranged parallel to the folding lines 70, 72 are folding lines 34. Via the folding lines 34, an adhesive-bonding or insertion flap 26', 28", is respectively formed as a sub-region of the respective side flaps 26, 28. Furthermore, it is evident from FIG. 1 that the adhesive-bonding flap 58 comes to lie on the front wall 22", and is adhesively bonded to said wall, at least in part.

In the exemplary embodiment illustrated, the front end side 16 is formed by the front walls 22, 22', 22" (see also FIG. 3), which are connected to one another via corresponding folding lines 64, 66, 68. The front wall 22" here is connected to the adhesive-bonding flap 58. The rear end side 18 is formed by the rear walls 24, 24', 24", which are connected to the top wall 14 and the base wall 12 via corresponding folding lines (see also FIG. 3).

Figure 2:
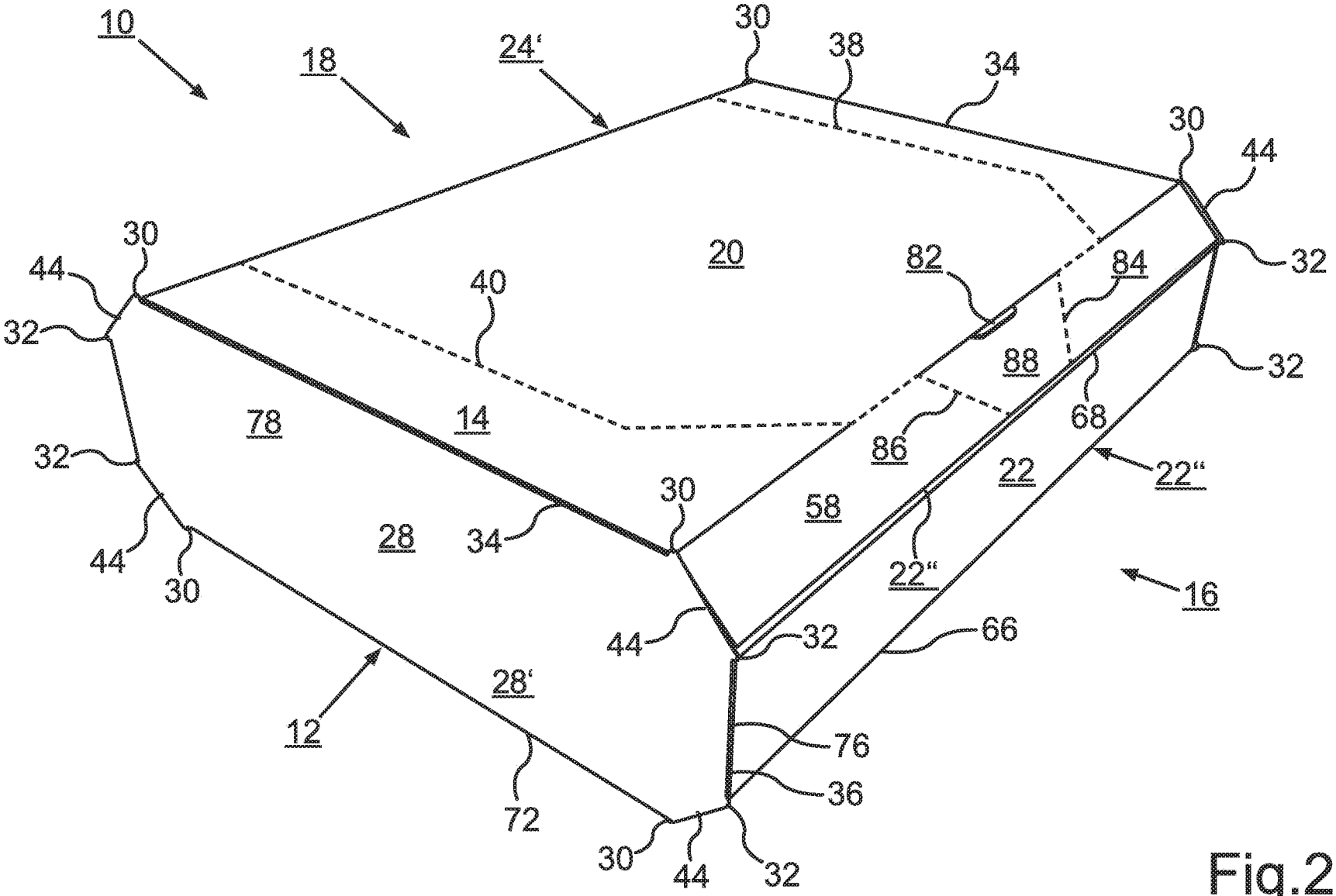
FIG. 2 shows a further schematic illustration of the packaging according to FIG. 1.

FIG. 2 shows a further schematic illustration of the packaging 10 according to FIG. 1. Evident once again is the overall octagonal configuration of the packaging 10, which lies horizontally on the base wall 12. It is also clear that the side flap 28 is connected to the base wall 12 via the folding line 22. The configuration of the overhangs 44 and of the resting noses 30, 32 means that there is a secure closure and a significant increase in stability of the packaging 10 in the regions of the front and rear end sides 16, 18 of the packaging 10. It is clear that even a deformation of the packaging 10 in these regions can be compensated to a certain degree without any problems. The overhang 44 or the resting noses 30, 32 can compensate for deformations in this region to some degree, and nevertheless still lie against the corresponding front or rear walls 22', 22", 24', 24".

As far as the description of the rest of the features illustrated in FIG. 2 is concerned, reference is made to the description relating to FIG. 1.

Figure 3:
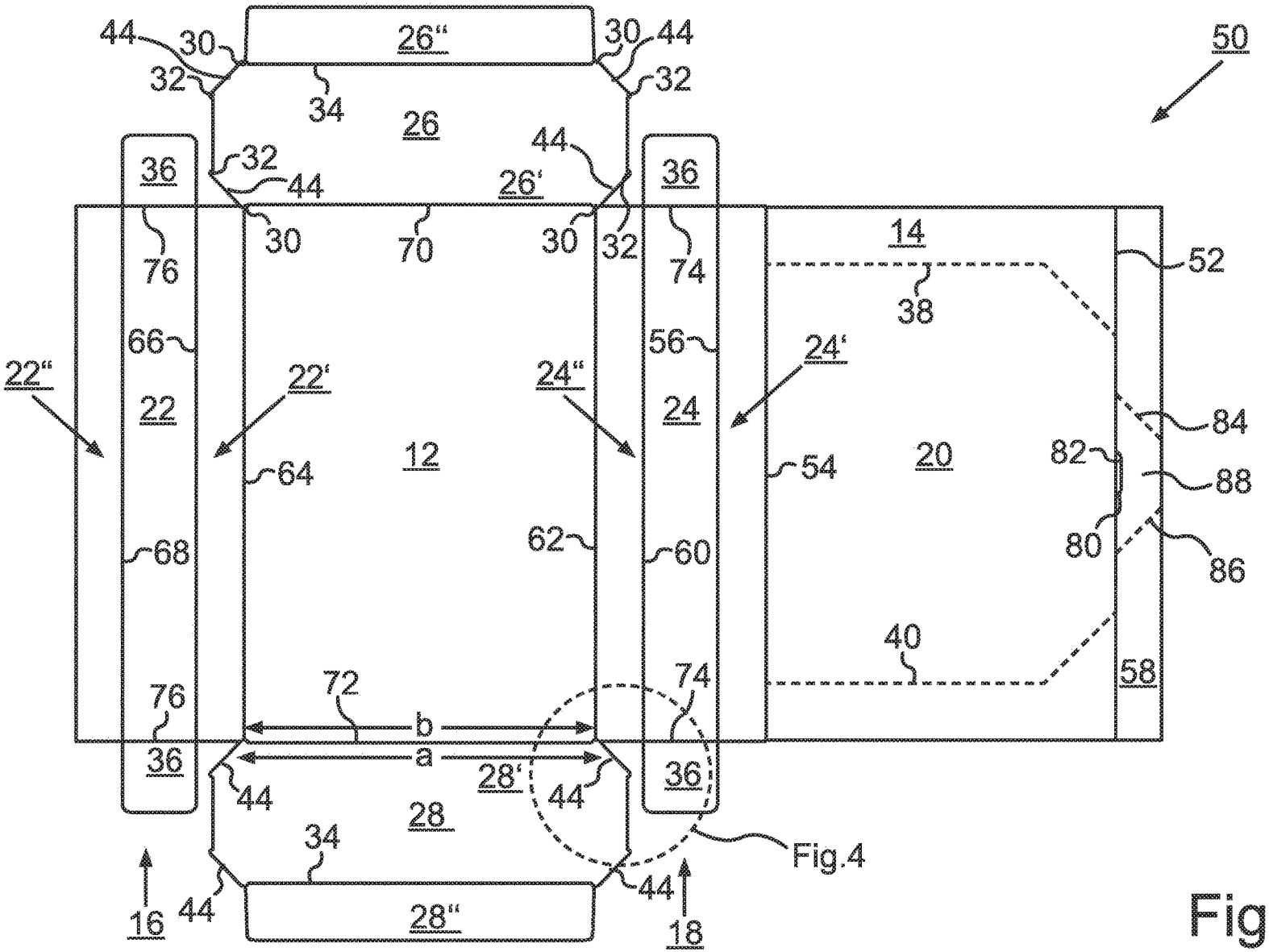
FIG. 3 shows a schematic illustration of a blank according to the invention for the packaging according to FIG. 1.

FIG. 3 shows a schematic illustration of a blank 50 of the packaging 10 according to FIG. 1 or FIG. 2. The blank 50 comprises base-wall, top-wall, front-wall and rear-wall elements 12, 14, 22, 22', 22", 24, 24', 24", which are connected via folding lines 52, 54, 56, 60, 62, 64, 66, 68 and are intended for forming the packaging 10 in the form of a prismatic body in the folded state of the blank 50 (see also FIGS. 1 and 2). It can be seen that the blank 50 comprises a respective dust flap 36, which is articulated at the ends of the front-wall element 22 and of the rear-wall element 24. The dust flaps 36 are each articulated the front-wall and rear-wall element 22, 24 via corresponding folding lines 74, 76. In addition, an adhesive-bonding flap 58 is articulated on the top-wall element 14 via the folding line 52.

It can be seen that the side flaps 26, 28 are designed such that, in the folded state of the blank 50 and in a closed position of the packaging 10, rest on the front and rear walls or front-wall and rear-wall elements 22', 22", 24', 24" and project beyond the same. In order to achieve this, a width a of the side flaps 26, 28 in the region of their respective articulation on the base-wall and/or top-wall element 12, 14 is greater than a width b of the base-wall or top-wall element 12, 14 in said region. This results in a kind of overhang 44 in the non-articulated region of the side flaps 26. The respective overhangs 44 then project beyond the front and rear walls 22', 22", 24', 24" in the folded state of the blank 50 and in the closed position of the packaging 10. In the exemplary embodiment illustrated, the side flaps 26, 28 are designed such that the side region connecting the overhangs 44 merely rests on the respective front and rear walls 22, 24 and does not project beyond them.

Furthermore, it is evident that the side flaps 26, 28 in the exemplary embodiment illustrated are altogether of an approximately octagonal design. Moreover, it is clear that the side flaps 26, 28 respectively have two sub-regions 26', 26", 28', 28". The first sub-regions 26', 28' are respectively connected here via folding lines 70, 72 to the base-wall element 12 of the blank 50. Via folding lines 34, which run parallel to the folding lines 70, 72, the respective second sub-region 26", 28" is articulated on the corresponding first sub-regions 26', 28'. The second sub-regions 26", 28" here can be designed in the form of an insertion and/or adhesive-bonding flaps.

In addition, the top-wall element 14 of the blank 50 has a tear-open flap 20, which is formed via the perforation lines 38, 40. In the region of the adhesive-bonding flap 58, the tear-open flap 20 is continued in a grip flap 88, which is formed via the perforation lines 84, 86. For easier opening of the tear-open flap 20, use is made of the pull tab 82, which is formed by means of the cut line 80.

FIG. 4 shows a schematic illustration of a detail of the blank 50 shown in FIG. 3. It is evident that the side flap 28 respectively has in its corner regions the overhangs 44 and also the resting noses 30, 32. For forming the overhang 44, a cut line delimiting the resting noses 30, 32 and also the overhang 44 projects into the region of the rear-wall element 24". This means that the said cut line does not cut the folding line 72, which connects the base wall element 12 to the side flap 28. Furthermore, it is evident that the dust flap 26 is articulated via the folding line 74 on the rear-wall element 24, which is connected to the further rear-wall element 24" via the folding line 60.

Figure 5:
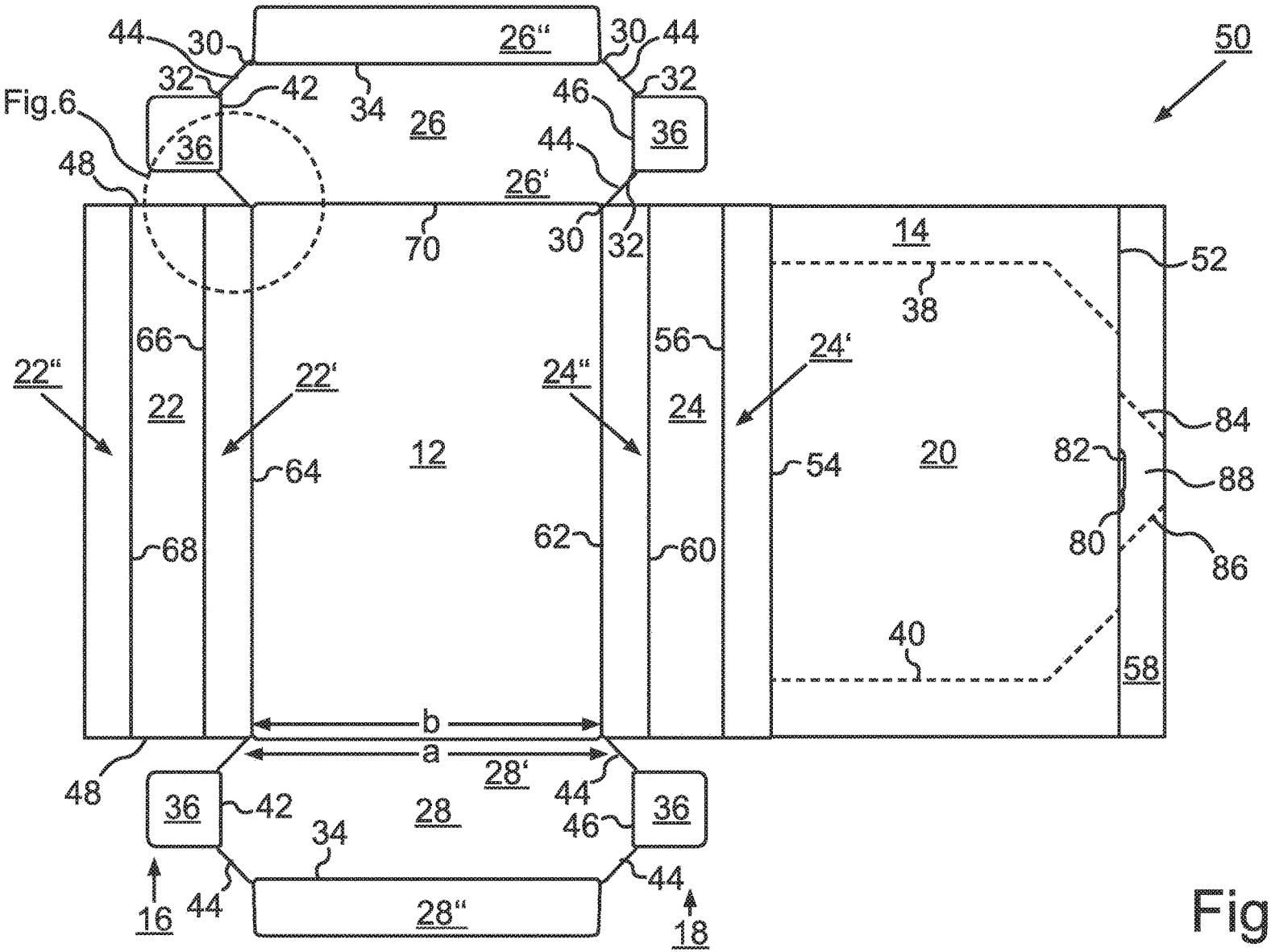
FIG. 5 shows a schematic illustration of a blank according to the invention for the packaging according to a further embodiment.

FIG. 5 shows a schematic illustration of a blank 50 of the packaging 10 according to a further embodiment. As a difference from the exemplary embodiment of the blank shown in FIG. 3, this exemplary embodiment shows a blank 50, in which the dust flaps 36 are not articulated on the front-wall or rear-wall element 22, 24 but on a non-articulated region of the side flaps 26, 28 via corresponding folding lines 42, 46. The dust flaps 36 may in this case also be used as insertion and/or adhesive-bonding flaps. It is clear that the side flaps 26, 28 nevertheless have the overhangs 44 with the corresponding resting noses 30, 32. For forming the overhangs 44, once again the width a of the side flaps 26, 28 in the region of their respective articulation on the base-wall or top-wall element 12, 14 is greater than the width b of the base-wall or top-wall element 12, 14 in said region. With respect to the description of the further features illustrated in FIG. 5, reference is made to the description relating to FIG. 3.

FIG. 6 shows a schematic illustration of a detail of the blank 50 shown in FIG. 5. It is evident that, in the case of this exemplary embodiment, the dust flap 36 is connected to the side flap 26 via the folding line 42. For forming the overhang 44 and also the resting noses 30, 32, the side flap 26 is once again configured in its corner regions in such a way that a cut line delimiting the overhang 44 and also the resting noses 30, 32 does not cut the folding line 70, which connects the base wall element 12 to the side flap 26. Furthermore, it is clear that the front-wall element 22 in the exemplary embodiment illustrated does not have a side flap but is merely delimited by a cut line 48.

Those exemplary embodiments of the packaging 10 and of the blanks 50 which are described in the figures above serve to clarify the basic principle of the present invention. In particular, a large number of differently designed packagings are conceivable. It is therefore possible for the cross-sectional surfaces 78 of the prismatic-body-design packaging 10 to be of not just octagonal design, but also of quadrilateral, pentagonal, hexagonal, heptagonal, nonagonal, decagonal, hendecagonal or dodecagonal design. However, other shapes, for example round shapes or combinations of round and polygonal shapes or triangular configurations, are also possible.

The packagings described above are designed in the form of folding boxes. They, like the associated blanks, consist, in particular, of cardboard, paper, plastic or comparable materials.

The invention claimed is:

1. A packaging made of cardboard, paper or the like, comprising:

a base wall and a top wall, at least a respective front wall and rear wall, which connect the base wall and top wall and are configured to form end sides of the packaging, wherein the packaging is designed in the form of a prismatic body along a longitudinal axis running parallel to the base wall and the top wall; and a side flap, which is articulated on the base wall and/or the top wall and is configured to close the packaging laterally, wherein the side flap is designed such that, in a closed position, the side flap rests, at least in part, on the front wall and the rear wall that connect the base wall and the top wall, projects, at least in part, beyond the front wall and the rear wall, and is configured such that, when in the closed position, the side flap completely covers over a region of a cross-sectional surface formed perpendicular to the longitudinal axis of the packaging, the region extending between the front and rear walls at the end sides of the packaging, such that the side flap is disposed perpendicular to the longitudinal axis and forms a lateral side of the packaging.

2. The packaging as claimed in claim 1, wherein a width of the side flap in a region of its respective articulation on the base and/or top wall is greater than a width of the base and/or the top wall in said region.

3. The packaging as claimed in claim 1, wherein the side flap has an overhang in a non-articulated region in such a way that, in the closed position of the packaging, the overhang projects beyond at least one of the front wall or the rear wall, at least in part.

4. The packaging as claimed in claim 3, wherein a resting nose is respectively formed at opposite ends of the at least one overhang.

5. The packaging as claimed in claim 3, wherein on the side flap, at least one dust flap is articulated in a region different from the overhang.

6. The packaging as claimed in claim 1, wherein the side flap is a first side flap and the region is a first region, and the packaging further comprises a second side flap that is configured such that, when the packaging is in the closed position, the second side flap completely covers over a second region of a cross-sectional surface formed perpendicular to the longitudinal axis of the packaging, the second region extending between the front and rear walls at the end sides of the packaging, wherein the second side flap is disposed perpendicular to the longitudinal axis and forms another lateral side of the packaging.

7. The packaging as claimed in claim 1, wherein at least one tear-open flap is formed within the top wall.

8. The packaging as claimed in claim 1, wherein the cross-sectional surface is of polygonal design, in particular quadrilateral, pentagonal, hexagonal, heptagonal, octagonal, nonagonal, decagonal or dodecagonal design, in a direction perpendicular to the longitudinal axis of the packaging of the prismatic-body-design packaging.

9. A blank for producing a packaging made of cardboard, paper or the like, comprising:

base-wall, top-wall, front-wall and rear-wall elements, which are connected via folding lines and are intended for forming the packaging in the form of a prismatic body in a folded state of the blank, wherein the blank includes a side flap, which is articulated on the base-wall element and/or the top-wall element, and wherein the side flap is designed such that, in the folded state of the blank and in a closed position of the packaging, the side flap rests, at least in part, at least on the front-wall element and the rear-wall element that connect the base-wall element and the top-wall element, projects, at least in part, beyond the front wall-element and the rear wall-element, and completely covers over a region of a cross-sectional surface of the packaging, the region extending between the front wall-element and the rear wall-element, wherein the side flap is configured to be disposed perpendicular to a longitudinal axis of the packaging to form a lateral side of the packaging.

10. The blank as claimed in claim 9, wherein a width of the side flap in a region of its respective articulation on the base-wall element and/or the top-wall element is greater than a width of the base-wall element and/or the top-wall element in said region.

11. The blank as claimed in claim 9, wherein the side flap has at least one overhang in a non-articulated region in such a way that, in the folded state of the blank and in the closed position of the packaging, the at least one overhang projects beyond at least one of the front-wall element or the rear-wall element, at least in part.

12. The blank as claimed in claim 11, wherein on the side flap, at least one dust flap is articulated in a region different from the at least one overhang.

13. The blank as claimed in claim 9, wherein the side flap is of a substantially polygonal design, in particular quadrilateral, pentagonal, hexagonal, heptagonal, octagonal, nonagonal, decagonal or dodecagonal design.

14. The blank as claimed in claim 9, wherein at least one tear-open flap is formed within the top-wall element.

15. The blank as claimed in claim 9, wherein the side flap is a first side flap and the region is a first region, and the blank further comprises a second side flap that is designed such that, in the folded state of the blank and in the closed position of the packaging, the second side flap completely covers over a second region of a cross-sectional surface formed perpendicular to the longitudinal axis of the packaging, the second region extending between the front wall-element and the rear wall-element, wherein the second side flap is configured to be disposed perpendicular to the longitudinal axis of the packaging to form another lateral side of the packaging.

* * * * *